US008182246B1

(12) United States Patent
Rohring

(10) Patent No.: US 8,182,246 B1
(45) Date of Patent: May 22, 2012

(54) HIGH PRESSURE OPEN DISCHARGE PUMP SYSTEM

(76) Inventor: Steve Rohring, Buffalo, NY (US)

( * ) Notice: Subject to any disclaimer, the term of this patent is extended or adjusted under 35 U.S.C. 154(b) by 1085 days.

(21) Appl. No.: 12/080,525

(22) Filed: Apr. 2, 2008

Related U.S. Application Data

(63) Continuation-in-part of application No. 11/008,763, filed on Dec. 9, 2004, now abandoned.

(51) Int. Cl.
*F04B 23/04* (2006.01)

(52) U.S. Cl. ..... 417/521; 417/63

(58) Field of Classification Search ..... 417/521, 417/63

See application file for complete search history.

(56) References Cited

U.S. PATENT DOCUMENTS

| | | | | |
|---|---|---|---|---|
| 2,697,403 | A | 12/1954 | Benedek | |
| 3,195,808 | A | 7/1965 | Holt | |
| 4,828,148 | A | 5/1989 | Haluda et al. | |
| 5,066,199 | A * | 11/1991 | Reese et al. | 417/63 |
| 5,993,174 | A | 11/1999 | Konishi | |
| 6,109,894 | A | 8/2000 | Chatelain | |
| 6,764,285 | B1 * | 7/2004 | Kellner | 417/470 |

* cited by examiner

*Primary Examiner* — Charles Freay
*Assistant Examiner* — Patrick Hamo
(74) *Attorney, Agent, or Firm* — Kloss Stenger & Lo Tempio; Vincent G. Lo Tiempo; Brendan Lillis

(57) ABSTRACT

A high-pressure cam driven open discharge pump system is provided, wherein a high-pressure output at a relatively constant pressure is formed. The pump system includes a plurality of pressurizing subassemblies, each subassembly including a cam follower retained by a cam follower support guided by guide bearings to induce linear motion of a connected piston rod. The piston rod is slidably received within a removable high-pressure cylinder assembly which retains a high pressure cylinder.

29 Claims, 8 Drawing Sheets

HIGH PRESSURE OPEN DISCHARGE PUMP SYSTEM

CROSS-REFERENCE TO RELATED APPLICATIONS

This application is a continuation in part of U.S. patent application Ser. No. 11/008,763 for HIGH PRESSURE OPEN DISCHARGE PUMP SYSTEM filed on Dec. 9, 2004 now abandoned.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to high pressure pump systems, and more particularly, to a cam driven high pressure open discharge pump system providing substantially constant pressure output with increased efficiency, and reduced maintenance downtime.

2. Description of Related Art

Pumps have been historically used for a variety of applications typically involving the transfer of liquids. The development of pumps has provided increased availability of pumping pressures. As pumping pressures have increased, the applications for such high pressure streams have increased.

Reciprocating piston pumps have been used to provide elevated flow rate pressures. However, the reciprocating piston pumps generate an undesirable pulse in the output pressure. Many recently developed applications for high-pressure systems require minimal spikes in the output pressure.

Centrifugal pumps are typically able to provide relatively constant output pressures, but cannot sufficiently produce high pressure and are relatively inefficient.

Therefore, the need exists for a high pressure pump system which can provide a relatively high and stable output pressure efficiently. The need also exists for a high pressure pump system that can provide component interchange, without extended downtime. The need further exists for a pump system that can be tailored to a specific application, without requiring complete retooling for manufacture of the system.

SUMMARY OF THE INVENTION

The present pump system provides a substantially constant flow rate at a desired high pressure output. In addition, the pump system is capable of delivering high-pressure liquids such as water, water with additives, liquid nitrogen as well as vegetable oils at constant elevated pressures and flow rates over substantial periods of operation. As used herein, the term "constant" is taken to be within 10% of a given predetermined value. The constant flow high-pressure liquid supply from the present pump system can be used for material cutting in the abrasive jet and fluid jet industries. In addition, applications which do not require through cutting of material such as cleaning, surface preparation, surface removal, milling, cleaning, sterilization and etching can employ a constant high-pressure liquid supply.

The present pump system includes a base plate; a cam shaft rotatably mounted to the base plate; a cam affixed to the cam shaft for rotation with the cam shaft; at least two pressurizing subassemblies in contact with the cam, each pressurizing subassembly including: (i) a piston guide block connected relative to the base plate; (ii) a piston rod slidably connected to the piston guide block; (iii) a cam follower support releasably connected to the piston rod; (iv) a cam follower connected to the cam follower support to contact the cam; and (v) a high pressure cylinder assembly releasably connected to the guide block to receive a length of the piston rod, the high pressure cylinder assembly including at least one sealed interface between the piston rod and the high-pressure cylinder assembly; a linear guide bearing connecting the cam follower support to the base plate; and a tie brace connected to each piston guide block. In a further configuration, the tie brace is rotatably connected to the camshaft, and in another construction at least one tie brace is connected to the base plate.

Further constructions of the pump system can include a plurality of pressurizing subassemblies, inlet and outlet check valves located upstream and downstream of the pump assembly, respectively; linear guide bearings connecting the cam follower support to the base plate.

DETAILED DESCRIPTION OF THE INVENTION

Figure 1:
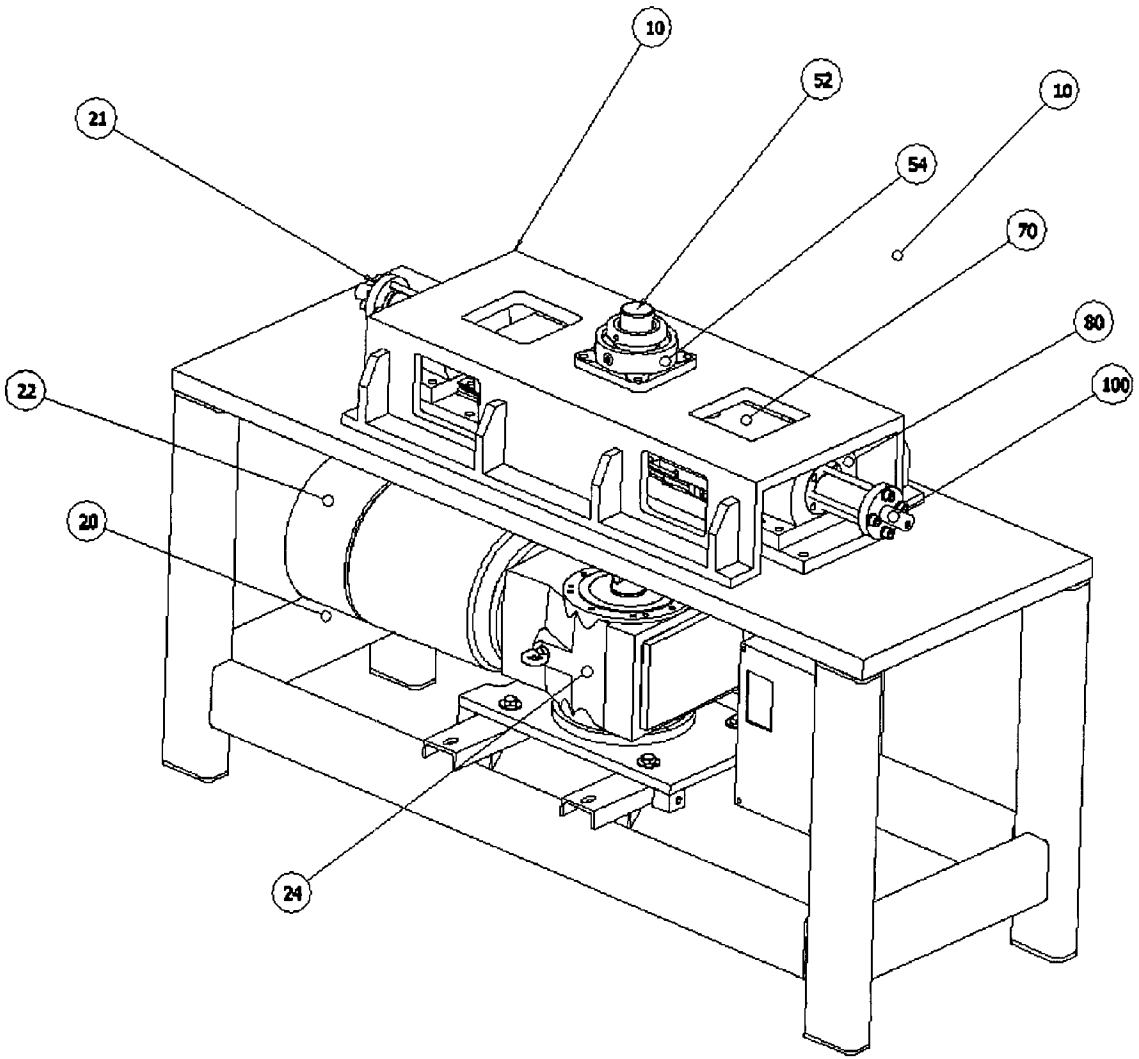
FIG. 1 is a perspective view of a high pressure pump system.
Figure 2:
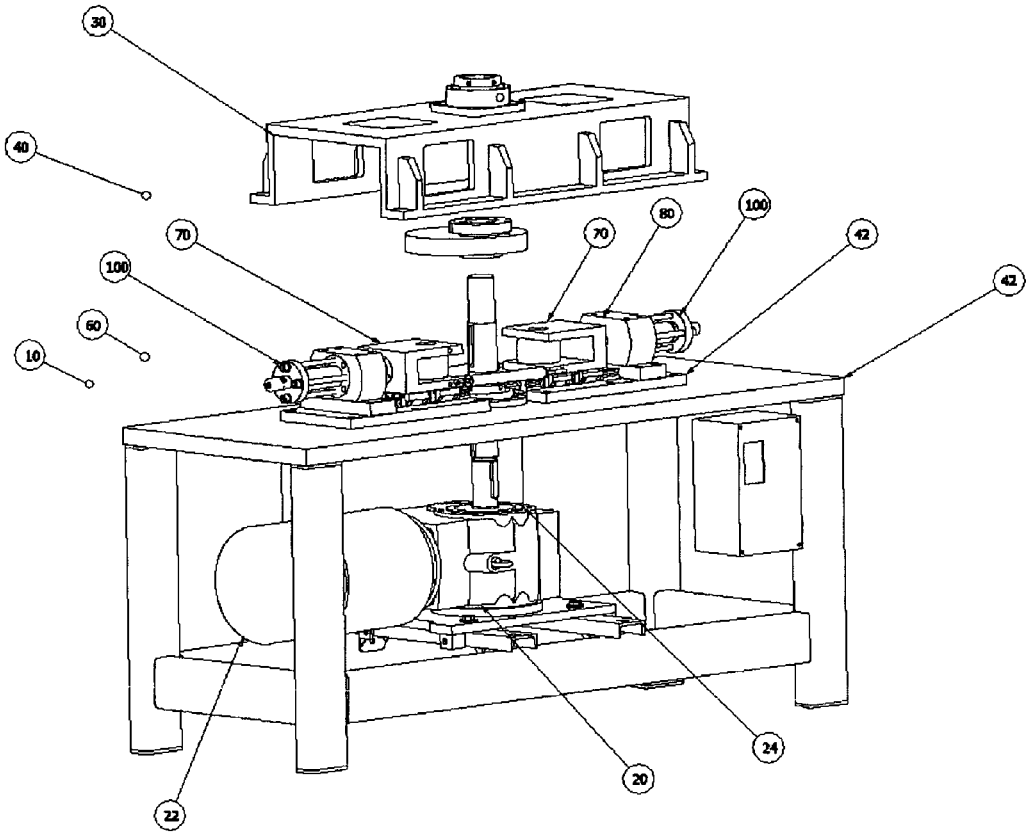
FIG. 2 is an exploded perspective view of the high pressure pump system of FIG. 1.

Referring to FIGS. 1 and 2, a high-pressure pump system 10 includes a drive mechanism 20 and a pump assembly 40.

The drive mechanism 20 is connected to the pump assembly 40 to provide a motive force for the pump assembly. The drive mechanism 20 includes a motor 22 and a transmission gearing such as a gearbox 24. The motor 22 can be one of AC or DC, with any style of electric coil or a magnetic motor such as a servo, stepper, inverter or vector motor. The motor 22 can be a constant or a variable speed motor. Alternatively, the motor 22 can be operated at a constant speed or a variable speed. A suitable electronic control for the drive mechanism 20 can be servo, vector, sensorless vector, or a variable frequency drive. A typical motor will be between 10 and 150 horsepower depending upon the number pressurizing subassemblies and desired output flow rate and pressure, with a likely range of 25 to 75 horsepower. A satisfactory motor 22 for a two pressurizing subassembly system is an inverter rated electric motor, on the order of 25 horsepower.

The gearbox 24 provides the transmission of power from the motor 22 to the pump assembly 40. Preferably, the gearbox 24 provides selective gear reduction between the motor 22 and the pump assembly 40, thereby increasing the available torque to the pump assembly. The gearbox 24 can provide incremental or continuously variable gearing. Typically, the gearbox 24 allows for increased torque from the drive mechanism 20. Although the motor 22 and the gearbox 24 are shown as separate structures, it is contemplated the motor and the gearbox can be integrated into a single unit. It is further understood that a specific motor providing the necessary torque and desired speed can be employed, wherein no gear reductions are employed. However, it is believed such motor is substantially more expensive than a readily commercially available motor in combination with a commercially available gearbox.

The drive mechanism 20 can be specifically configured for a given pump assembly 40, including specific output pressure requirements and flow rates, thereby providing at least a substantially constant output speed. Alternatively, the drive mechanism 20 can provide a variable output speed, such as in response to user control or operating environment feedback. For example, a PLC or motion controller can be employed to generate a constant output flow rate of the high pressure liquid. Similarly, feedback from gauges can be used to control the output of the drive mechanism 20. For example, the gauges can relay pressure spike signals which result in a corresponding compensation in the speed of the drive mechanism 20.

It is contemplated the drive mechanism 20 will provide a rotation rate of approximately 30 rpm to approximately 60 rpm. However, it is understood different rotation rates can be employed. Typically, the rotation rate is selected to at least increase the useful life of the drive mechanism 20. Rather than require the drive mechanism to operate at inefficient or relatively determined speeds, the cam 50 can be configured to optimize efficiency of the drive mechanism 20, as well as improve power consumption of the pump system 10 by improving the relationship of fluid horsepower to the drive system horsepower. For example, the pump system 10 can be over 95% efficient in the use of electric consumption to create fluid horsepower. Thus, optimization of the pump system 10 will result in less than 5% loss of energy throughout the pressurization of the fluid.

The pump assembly 40 generally includes a base plate 42, a cam 50, at least two pressurizing subassemblies 60 and a tie brace 30.

As seen in FIGS. 1, 2-5 and 6, the base plate 42 forms a rigid platform to which the remaining components are attached or connected. The base plate 42 can be a single integral member or can be formed of a plurality of subplates 42' which are fixedly connected or attached. Although the base plate 42 can be formed from a variety of materials or manufacturing methodologies, in view of the forces generated within the system steel has been found to be a satisfactory material.

In addition, the base plate 42 can be a substantially planar member or can be stepped either as an integral member or through a combination of the subplates 42'. Similarly, the base plate 42 can be cast, machined, welded or bonded components to provide the necessary structural rigidity and strength in a planar or configured shape.

The base plate 42 includes an aperture (not shown) for rotatably receiving a cam shaft 52. Bearings or journals 54 are affixed to the base plate 42 for providing a rotatable interface between the cam shaft 52 and the base plate.

The cam 50 is connected to the cam shaft 52 for rotation therewith. In one configuration, the cam 50 is releasably connected to the cam shaft 52, such as by key ways, slots, tabs, pins, detents, retaining rings (collars), shrink fitting (sweating), clamping or other releasable means. It is also contemplated that a permanent connection between the cam 50 and the cam shaft 52 can be employed. However, such permanent connected does not provide for as ready interchange of components or replacement of worn components, and is thus believed to be inferior than the releasable connection.

The cam 50 includes a cam profile 56 selected to provide a substantially constant high-pressure output for the pump system 10. The cam profile 56 can be configured to accommodate a variety of system parameters such as fluid compression, downstream liquid volume, valving delay (timing) as well as the desired flow rate. In addition, the cam profile 56 can be configured to accommodate other parameters within the pump system 10 which impact at least one of the pressure or flow rate variables of the system output including application or use parameters. The cam profile 56 is a spline curve, rather than merely an offset mounting on the cam shaft 52, as the spline curve can be selected to provide the desired constant output. Typically, the cam profile 56 more than 50% of the length of the profile will define a rising slope, such as, for example, 60%, with at least a substantial portion of the remaining profile length being decreasing slope. Thus, the rates of acceleration and deceleration of the piston rod 90 can be controlled. It is also contemplated that by employing at least three pressurizing subassemblies 60, a standard eccentric offset cam can be used in conjunction with a varying speed of the drive mechanism 20 to provide a constant output of the pump system 10.

Similarly, system lag such as electrical, mechanical or fluidic lag can be compensated by the cam profile 56. Partial or complete compensation can be designed into the cam profile 56 or partially designed into the cam profile in cooperation with a variable speed from the drive mechanism 20. This compensation scheme can also be used to accommodate an amount of high-pressure liquid accumulation downstream of the pump assembly 40, such as within high-pressure tubing or hoses, valves and fittings and attenuators. Typically, the amount of downstream high-pressure liquid is system dependent. Different cutting systems and operating pressures typically have different high pressure volumes. However, the downstream high-pressure volume is typically constant once the pump system 10 is installed. Therefore, the cam 50 and the drive mechanism 20 can be selected to provide an operating range of flow rates and pressure.

The cam 50 is preferably formed of a relatively hard material, at least harder than a cam follower. A satisfactory hardness is believed to be approximately 55 to 60 on the Rockwell C hardness scale.

Also referring to FIGS. 1, 2, 5 and 6, the pressurizing subassemblies 60 are located to contact the cam 50. At least two pressurizing subassemblies 60 are employed. However, it is understood that 3, 4, 5, 6 or more pressurizing subassemblies 60 can be driven by a given cam 50.

Generally, the pressurizing subassemblies 60 are located at equally spaced locations about the cam 50. For example, 360/(number of pressurizing subassemblies)=angle between the subassemblies.

For purposes of description, a single pressurizing subassembly 60 is described in detail, with the understanding that the remaining pressurizing subassemblies are of substantially identical construction. However, it is understood different pressurizing subassemblies can be used in conjunction with a single cam 50, or individual corresponding cams on the cam shaft 52.

The pressurizing subassembly 60 includes a cam follower support 70, a piston rod 90, a piston guide block 80 and a high-pressure cylinder assembly 100.

As seen in FIGS. 1, 2, 5 and 6, the piston guide block 80 is fixedly mounted to the base plate 42. As seen in these figures, the piston guide block 80 is fixedly connected to a subplate 42' which in turn is fixedly connected to the base plate 42, thereby effectively being fixedly connected to the base plate. The piston guide block 80 includes an aperture 81 therethrough sized to receive the piston rod 90. In addition, the piston guide block 80 includes a mounting face 82 for cooperatively engaging the high pressure cylinder assembly 100.

The cam follower support 70 locates a cam follower 74 relative to the cam 50. The cam follower support 70 is slidably connected to the base plate 42 by guide bearings 72 and preferably linear guide bearings. The guide bearings 72 are selected to permit single axis travel of the cam follower support 70 relative to the base plate 42 and hence piston guide block 80. The guide bearings 72 can be configured as linear bushings, slides, contact rails or grooves or other methods of providing linear movement which dictate motion of the cam follower support 70 along a single axis.

The cam follower support 70 can be any of a variety of configurations, such as a studded cam follower mounted to a plate or a yoke as seen in the figures. The yoke configuration of the cam follower support 70 has been found satisfactory in providing stability of the cam follower 74. Although the cam follower support 70 is shown as locating the cam follower 74 between the arms of the yoke, it is understood the yoke can be configured as the studded cam follower mounted on a plate, which in turn is mounted to the guide bearings 72. It is also contemplated the cam 50 can have a cam profile 56 in the form of a gear (along the spline profile) and the cam follower 74 can include a corresponding surface for engaging the spline profile gear of the cam 50 throughout rotation of the cam.

The cam follower 74 is connected to the cam follower support 70 for contacting the cam 50. In one configuration, the cam follower 74 is a wheel rotatably mounted to the cam follower support 70, so as to reduce nonaxial forces on the cam follower support. The cam follower 74 is a softer material than the cam 50. For a cam 50 having a hardness of approximately 55-60 Rockwell C Hardness Scale, the cam follower 74 has a hardness of approximately 40 to 45. Thus, the cam follower 74 being a standard shape can be readily replaced, thereby increasing the useful life of the cam 50.

The piston rod 90 is releasably connected to the cam follower support 70 and is sized to be slidably received through the piston guide block 80. The piston rod 90 can be connected to the cam follower support 70 by threaded connection collar or clamp fitting. Alternative connections include a taper lock bushing, a shrink fit collar or removable collar. The piston rod 90 can be constructed as a cylindrical smooth surfaced plunger, as shown in the figures, or a piston having a retaining groove for retaining a sealing ring. The piston rod 90 can thus be disassembled from either end of the guide block 80 depending on the removal of the collar and the relation of the guide block to the base plate 42.

Figure 3:
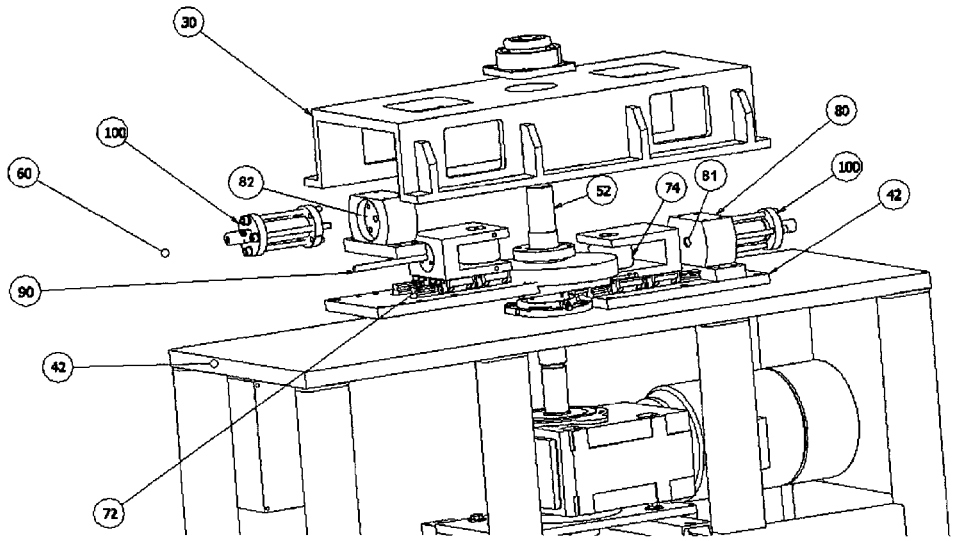
FIG. 3 is an exploded perspective view of a portion of the high pressure pump system.
Figure 4:
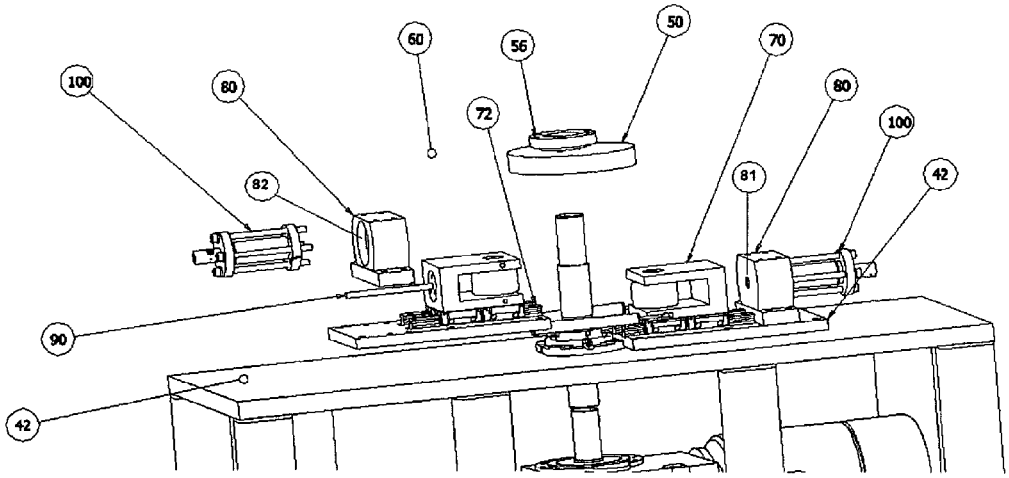
FIG. 4 is an exploded perspective view of a portion of the high pressure pump system with the tie brace not shown.
Figures 5, 6:
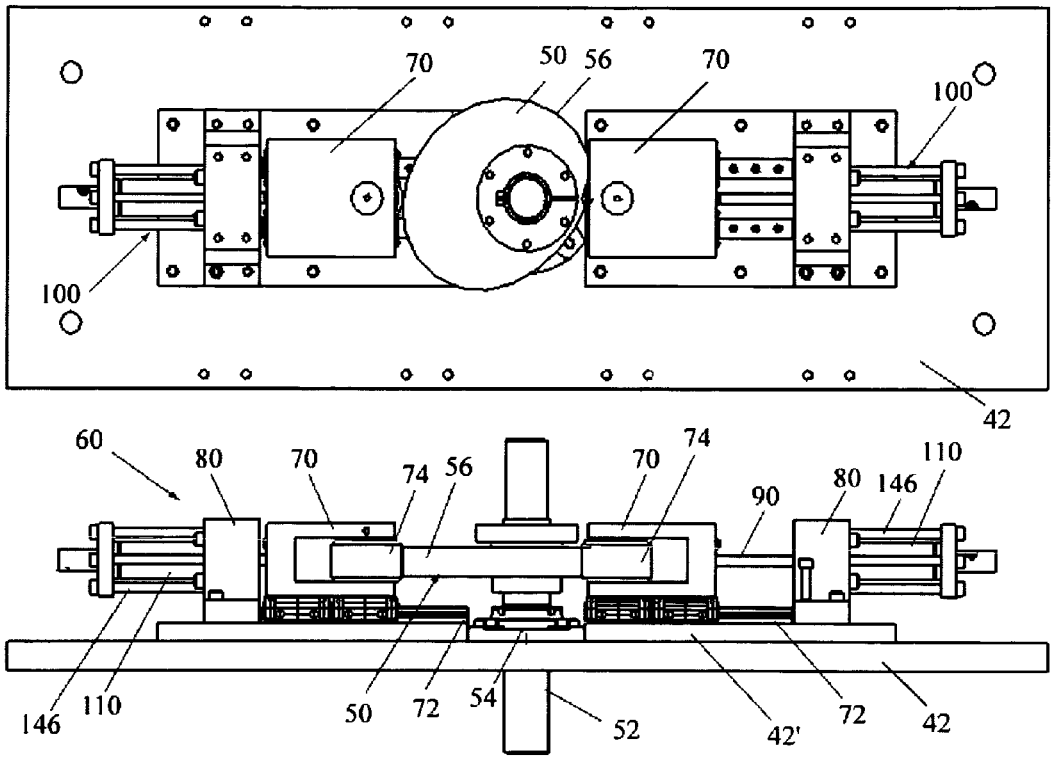
FIG. 5 is a top plan view of the high pressure pump system, without a tie brace.
FIG. 6 is a side elevational view of the high pressure pump system as shown in FIG. 5.
Figure 7:
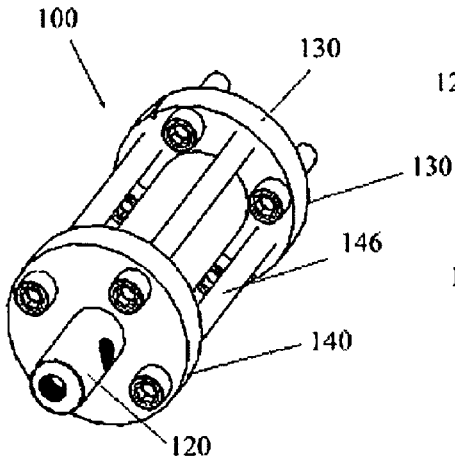
FIG. 7 is a perspective view of the high pressure cylinder assembly of FIG. 1.

Referring to FIGS. 3-4, the high-pressure cylinder assembly 100 is releasably connected to the piston guide block 80 to receive a portion of the piston rod 90 through a range of reciprocated motion of the piston rod. The releasable connection of the high pressure cylinder assembly 100 to the piston guide block 80 can be accomplished by any of a variety of mechanisms, such as threaded fasteners, friction or clamping.

In one configuration, the piston 90 rod is slidably received within the high-pressure cylinder assembly 100, wherein the cylinder assembly does not include any structure for capturing or locking the piston rod within the high-pressure cylinder assembly. Thus, the high-pressure cylinder assembly 100 can be disconnected from the piston guide block 80 and withdrawn from operable engagement with the piston rod 90, without requiring secondary operations or disconnects.

Figure 1B:
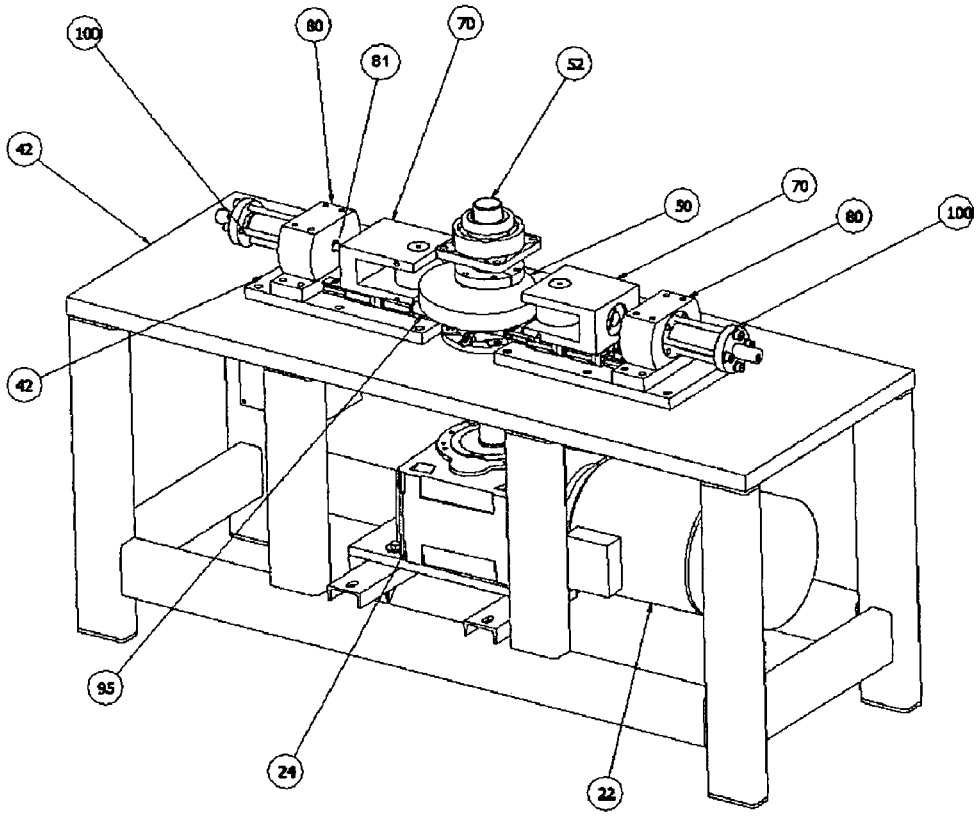
FIG. 1*b* is a perspective view of the high pressure pump system of FIG. 1, with the tie brace removed.

Referring to FIG. 1*b*, a return bias mechanism 95 is operably connected between the cam follower supports 70, or the cam follower supports and the base plate 42. The return bias mechanism urges the cam follower 74 to remain in operable contact with the cam 50 throughout the cycle of motion of the piston rod 90. Thus, the complete range of motion of the piston along both axial directions of travel is dictated by the cam 50. In one configuration, the return bias mechanism 95 includes a spring urging two cam follower supports 70 together. That is, the cam follower 74 connected to each cam follower support 70 is biased against the cam 50, such that cam profile 56 dictates the axial velocity of the piston rod 90.

The high-pressure cylinder assembly 100 can be a substantially integral construction or an assembly of individual components which can be readily disassembled by the operator.

Figure 21:
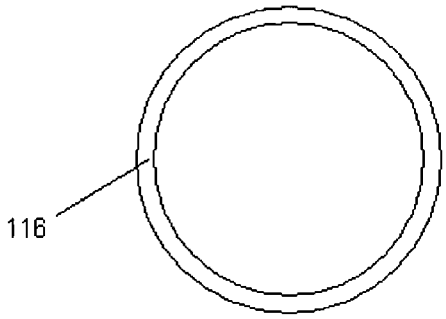
FIG. 21 is a top plan view of a seal.
Figure 22:
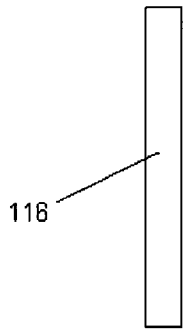
FIG. 22 is a side elevational view of the seal of FIG. 21.

The high-pressure cylinder assembly 100 includes a high-pressure cylinder 110 and a valving body 120. The high-pressure cylinder 110 slidably receives a portion of the piston rod 90. A sealed interface is a formed between an inner diameter of the high-pressure cylinder 110 and an outer diameter of the piston rod 90. The sealed interface is formed by a seal 116 as shown in FIGS. 21 and 22. However, alternative seal constructions can be employed, such as a piston ring on the piston rod 90, wherein the piston ring forms a sealed interface between the piston rod and the high pressure cylinder 100.

Figure 9:
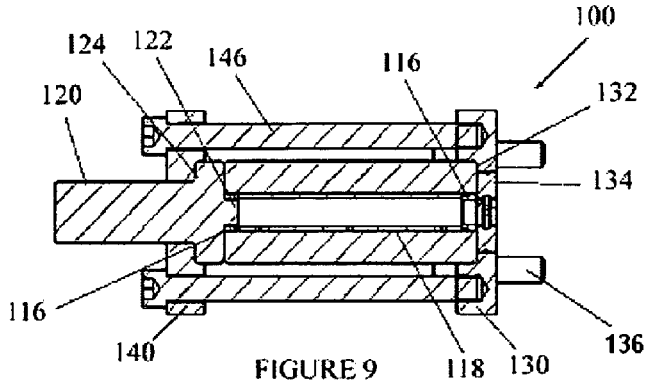
FIG. 9 as a cross-sectional view of the high pressure cylinder assembly of FIG. 7.
Figure 11:
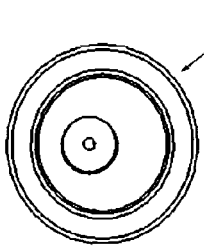
FIG. 11 as a front end elevational view of the valving body of FIG. 10.

Alternatively, the seal 116 is disposed in the annular space between the piston rod 90 and an inner surface of the high pressure cylinder 110. As seen in FIG. 9, the seal 116 is axially located adjacent a bushing and retained in the intended location by an axially extending cylindrical spacer 118. The spacer 118 can be sized to also contact the seal between the valving body 120 and the high-pressure cylinder 110. The spacer 118 is sized to substantially preclude bearing contact with the piston rod 90 or the high-pressure cylinder 110. Thus, wearing forces on the spacer 118 are minimized.

Figure 23:
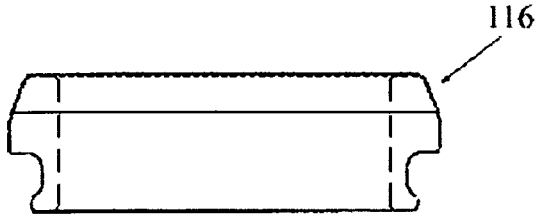
FIG. 23 is a side elevational view of an alternative seal body.
Figure 24:
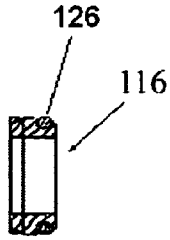
FIG. 24 is a cross sectional view of a seal assembly employing the seal body of FIG. 23.

Referring to FIGS. 23 and 24, a further alternative seal construction is shown. In FIG. 23, a plastic seal body is shown, wherein the seal body can be employed in conjunction with an O-ring and a metal hoop. As seen in FIG. 24 an O-ring is installed in a grooved area of the plastic seal body of FIG. 23, with the metal hoop also installed.

As the high-pressure cylinder assembly 100 can be readily removed from the piston guide block 80 and the piston rod 90 withdrawn from the high-pressure cylinder 110 without requiring any disconnects of the cam 50, the drive mechanism 20, the cam shaft 52, the cam follower support 70 or the piston rod, the seal 116 is readily accessible, and hence replaceable. That is, the releasable connection of the piston rod 90 to the cam follower support 70 and the high pressure cylinder assembly 100 allows the seals to be readily replaced without requiring disassembly of individual components of the system 10.

The construction of the high-pressure cylinder assembly 100 as an assembly of separate components includes a mating plate 130, a capture plate 140, the high-pressure cylinder 110, and the valving body 120 is also contemplated.

Figure 8:
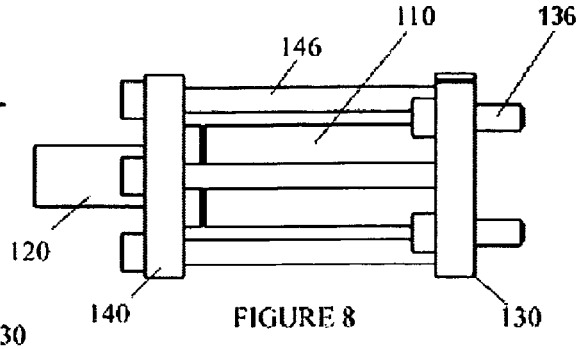
FIG. 8 is a side elevational view of the high-pressure cylinder assembly of FIG. 7.

The mating plate 130 is selected to cooperatively, and releasably engage the piston guide block 80. The mating plate 130 can also include a seat 132 for receiving an end of the high-pressure cylinder 110. The mating plate 130 includes a central aperture (not shown) sized to receive the piston rod 90. In one configuration, the central aperture (not shown) is sized to receive a bushing 134 which in turn receives the piston rod 90. The mating plate 130 can be operably connected to the piston guide block 80 by any of a variety of fastener such as threads, clamps, detents, stop collars and other methods of connection. As seen in FIGS. 8 and 9, the mating plate 130 includes fastening apertures (not shown) to receive threaded fasteners 136 which engage the piston guide block 80 to retain the mating plate 130 (and cartridge 100) relative to the piston guide block.

The capture plate 140 includes a central aperture (not shown) sized to engage a portion of the valving body 120. The capture plate 140 is generally spaced from the mating plate 130 by the length of the high-pressure cylinder 110 and a portion of the valving body 120. The capture plate 140 thereby retains the high-pressure cylinder 110 and a portion of the valving body 120 intermediate the capture plate and the mating plate 130. A plurality of tie rods 146 can be used to pass through or engage the capture plate 140 and correspondingly engage the mating plate 130 so as to effectively clamp or hold the high-pressure cylinder 110 and a portion of the valving body 120 between the capture plate and the mating plate. In one construction, the tie rods 146 are selected for releasable connection so that the individual components can be replaced as necessary or desired while maintaining a connection of the mating plate 130 to the piston guide block 80. Alternatively threaded cylinder with mating threaded receptacles in the capture and mating plates are contemplated.

The valving body 120 includes a button 122 sized to be received within the high-pressure cylinder 110. A sealed interface is formed between an outer diameter of the button 122 and an inner diameter of the high-pressure cylinder 110. An O-ring seal 126 is disposed in the annular space between the button 122 and the high pressure cylinder 110. The spacer 118 can be used to axially retain the seal 126 in the plunger style piston rod, but is not used in the piston ring seal style. Alternatively threaded valving body with mating threaded receptacles are contemplated.

Figure 10:
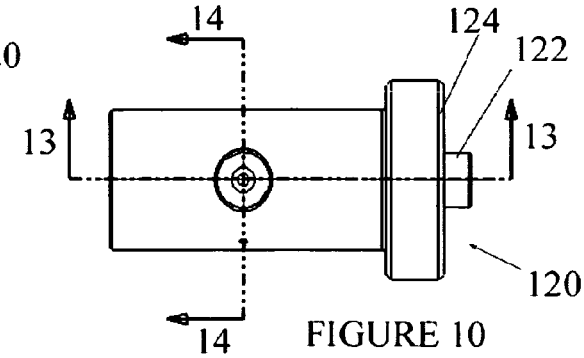
FIG. 10 is a top plan view of a first configuration of a valving body.
Figure 12:
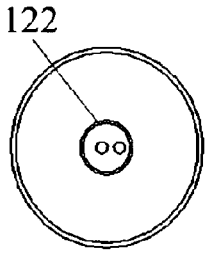
FIG. 12 is a rear end elevational view of the valving body of FIG. 10.
Figure 13:
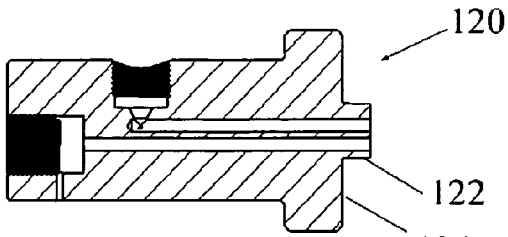
FIG. 13 is a cross-sectional view taken along lines 13-13 of FIG. 10.
Figure 14:
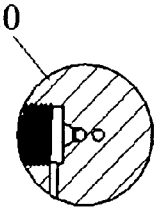
FIG. 14 is a partial enlarged cross-sectional view of the valving body of FIG. 10 taken along lines 14-14.
Figure 16:
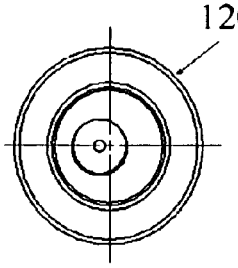
FIG. 16 is a front end elevational view of the valving body of FIG. 15.
Figure 15:
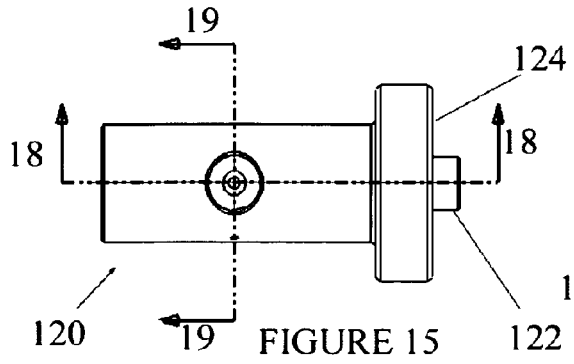
FIG. 15 is a top plan view of an alternative valving body.
Figure 17:
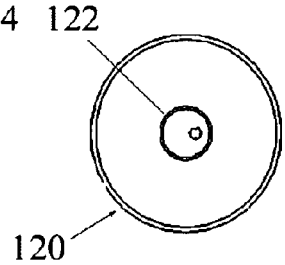
FIG. 17 is a rear end elevational view of the valving body of FIG. 15.
Figure 18:
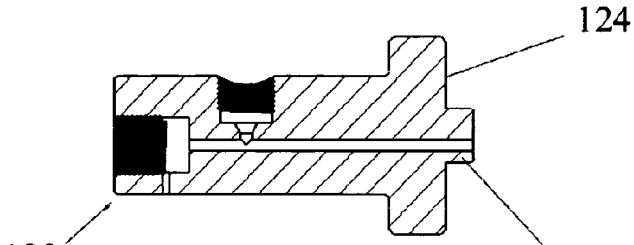
FIG. 18 is a cross-sectional view taken along lines 18-18 of FIG. 15.
Figure 19:
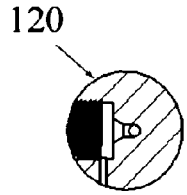
FIG. 19 is an enlarged partial cross-sectional view taken along lines 19-19 of FIG. 15.
Figure 20:
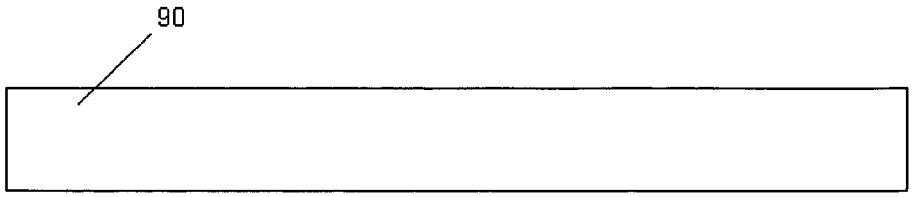
FIG. 20 is a side elevational view of a piston rod.

As seen in FIGS. 9, 10 and 13, the valving body 120 also includes a shoulder 124 sized to contact a portion of the capture plate 140 so as to retain the button 122 within the high-pressure cylinder 110.

The valving body 120 shown in FIGS. 10-14 is constructed for a pump system 10 having an inlet and outlet check valve (not shown) located external to the high-pressure cylinder assembly 100. That is, the valving body 120 has a separate inlet port and a separate outlet port, thereby providing that the low pressure incoming fluid and the high pressure outgoing fluid do not pass through the same passage in the valving body. In this construction, the check valves can be located outside of the high-pressure cylinder, and thus can be readily replaced as necessary. The inlet check valve permits the selective passage of low pressure liquid into the pump system 10, while precluding flow in a reverse direction. The outlet check valve permits the passage of high-pressure liquid from the pump system 10, while precluding flow in a reverse direction. Satisfactory inlet and outlet check valves have been found to include commercially available ball and seat style valves or poppet style valves.

Alternatively, as seen in FIGS. 15-18, the valving body 120 can include a single passageway. In this construction, the inlet and outlet check valves can be located outside the pump system 10. Alternatively, the inlet and outlet check valves can be located within the high-pressure cylinder assembly 100. It is further contemplated that one of the inlet or outlet valves can be inside the high-pressure cylinder assembly 100 and the remaining check valve can be external to the high-pressure cylinder assembly.

The tie brace 30 is rigidly connected to at least one of the piston guide blocks 80. The tie brace 30 can also be connected to the cam shaft 52 (via the bearings 54). The bearings 54 allow rotation of the cam shaft 52 relative to the tie plate 30. In such configuration, the tie brace 30 fixes the position of the cam shaft 52 axis and the piston guide blocks 80, thereby at least reducing relative movement of the piston guide blocks relative to each other and the base 42. By fixing the relative positions and orientations of the piston guide blocks 80 and the cam shaft 52, the power from the drive mechanism 20 is efficiently applied to the piston rod 90 and hence the fluid. The tie brace 30 is a rigid material such as metal or laminate. A satisfactory material has been found to be steel.

It is also contemplated the tie brace 30 can be separate pieces, each piece connecting one guide block 80 to the base plate 42. Alternatively, the tie brace 30 can connect the guide blocks 80 together. Thus, the tie brace 30 can connect the guide blocks 80 together, connect the guide blocks to the base plate 42 or connect the guide blocks together and the guide blocks to the base plate. The tie brace 30 can have any of a variety of configurations, including but not limited to plates, trusses, bars or brackets. It is also contemplated the tie brace 30 and the base plate 42 can be connected together to form a frame to which the piston guide blocks 80 are attached. The tie brace 30 reduces movement of the respective guide block 80 relative to the base plate 42, thereby reducing wear on the sealing and bearing surfaces of the pump assembly 10. In addition, as the tie brace 30 reduces movement of the guide blocks 80 relative to the base plate 42, mechanical lag of the pump system 10 is reduced, and thus such lag does not require compensation by the cam profile 56.

Although not shown, a separate cam shaft support can be rotatably connected to the cam shaft 52 and the base plate 42 to reduce deflection of the cam shaft under load. For example, an axial bearing can be connected to the base plate 42, rather than the tie brace 30, so that the axial bearing absorbs radial forces on the cam shaft 52 and reduces deflection of the cam shaft without requiring connection of the cam shaft to the tie brace 30. It is also contemplated that the cam shaft 52 can be sized to have a sufficient diameter to substantially preclude flexing under load, thereby allowing operation of the pump system 10 without connection to the tie brace 30.

In an alternative construction, the piston guide blocks 80 can be constructed to provide a bearing surface that extends along a substantial length of the respective piston rod 90. For example, the piston guide block 80 can have a bearing surface extending along at least 50% of the length of the piston rod 90. In one construction, the axial length of the bearing surface between the piston guide block 80 and the piston rod 90 can be greater than the height of the piston rod from the base plate 42. It is also contemplated the height of the piston rod 90 from the base plate 42 can be reduced, thereby reducing the effective lever arm between the bearing surface of the piston guide block 80 and the base plate 42. In one such implementation, the base plate 42 can be constructed of differing elevations, with a reduced elevation to bring the cam 50 (and aligned subassemblies) relatively close to base plate 30, and a relatively elevated portion at the piston guide blocks 80 to reduce the distance from the base plate to the bearing surface of the piston guide block.

Thus, depending upon the desired output pressure of the pump system 10, the extended bearing surface length of the piston guide block 80, the reduced lever arm distance (by individual component sizing or construction of the base plate 42) or a combination of both can sufficiently reduce flexing to allow operation of the pump system 10 without a tie brace 30.

The pump system 10 can include downstream flow passageways for conducting the high-pressure liquid to a discharge. In one configuration, the downstream flow passageways are constructed to reduce turbulence in the flow. It is believed the turbulence can be decreased by reducing the diameter of the flow path down stream of the outlet check valves. The reduction in the flow path diameter can be accomplished by funneling or stepdowns. It is believed this reduction in turbulence is desirable in certain material removal applications.

Typically, the pump system 10 is used in conjunction with a downstream system head not shown for expressing the high-pressure flow. The system head is fluidly connected to the pump system 10 by the high-pressure flow path which can include tubing, fittings, valves or other flow control devices. The system head can be any of a variety of configurations including an orifice, a nozzle, a focusing tube or any combination thereof. Thus, the pump system 10 is used in an open system, wherein the high-pressure flow is expressed to a lower pressure, typically an ambient pressure.

The system head can also include forming high-pressure discharge streams for cutting through very soft to very hard materials. The system head can include slitting or crosscutting in a single axis to a three axis system, or shape profiling in two axes to seven axes with gantry or articulated arm applications. The system head can also be handheld for manual operation or attached to robotic ambulatory devices.

It is also contemplated the downstream flow path can include an accumulator not shown for the high-pressure liquid. Depending upon whether an accumulator is employed in the downstream flow path, the cam profile can be constructed to accommodate the presence or absence of the accumulator.

A controller can be operably connected to at least one of the drive mechanism 20, the pump assembly 40 and any associated monitoring devices such as meters or gauges. The monitoring devices can include pressure gauges located to provide a signal corresponding to a pressure in the selected portion of the pump system, temperature sensors, timing devices as well as flow meters. Depending upon the configuration of the pumping system 10, the controller can be a separate processor such as a laptop computer running dedicated software. Alternatively, the controller can be integrated into the pump system, such as with the drive mechanism or the pump assembly.

Although the pump system 10 is described in terms of a single cam 50 for a plurality of pressurizing subassemblies 60, it is contemplated that each subassembly 60, or group of subassemblies can be driven by a corresponding cam 50. Thus, each pressurizing subassembly 60 can be driven by a unique cam 50 (and can profile 56). For example, if four pressurizing subassemblies 60 are to be driven, a first cam 50 on the cam shaft 52 is aligned with the first and second subassemblies, and a second cam 50 on the cam shaft 52 is aligned with the third and fourth subassemblies. Depending upon the desired characteristics of the output high pressure flow, the pump system 10 can include any of a variety of cam 50 to pressuring subassembly 60 relations.

In operation, the drive mechanism 20 induces rotation of the cam 50. The rotating cam 50, by contact of the cam profile 56 and the cam follower 74 of each pressurizing subassembly 60, controls the velocity of each piston rod 90. The velocity of the piston rod 90 relative to the high-pressure cylinder 110 (and in conjunction with a downstream discharge orifice and the upstream and downstream check valves) provides a corresponding increase in fluid pressure. The velocity of the piston rod 90 relative to the high-pressure cylinder 110 can be a function of a constant rotation rate of the cam 50, or a varied cam rotation*rate in combination with a predetermined cam profile 56 so as to provide a constant output pressure and flow rate.

Although the present pump system 10 can be used to provide a variety of pressures and flow rates, it is anticipated the flow rate will be less than 20 gallons per minute at a pressure greater than 30,000 psi, and depending upon the sealing configuration, greater than 100,000 psi. It is also understood that the pump system 10 can characterized as a high pressure pump providing pressures greater than approximately 10,000 psi.

It is also contemplated, the pump system 10 can be configured to provide a substantially constant high-pressure flow rate at selected intermittent intervals. By substantially constant, it is understood that the flow rate is within 10% of a given value. The intermittent constant high-pressure output flow rate can be provided by selectively venting the pump system 10, or controlling the drive mechanism 20. For example, the high-pressure flow path downstream of the pump system 10 can include a discharge valve, such as a dump valve (not shown), drain valve, a pressure relief valve or a bypass valve to pass the high-pressure flow to a drainage system or an on/off valve. These types of valves (not shown), along with metering valves (not shown), can also be used in conjunction with the pump system 10 to help produce a constant flow rate by reducing pressure fluctuation via draining excess flow to achieve the desired effect for continuous flow applications such as waterjet cutting. Alternatively, the drive mechanism 20 can be controlled to temporarily cease creating high pressure output.

The interchangeability of the cam 50 in the pump system 10 allows a given system to provide different output flow rates and pressures in response to use of corresponding cams. That is, a given pump system 10 with a first cam could provide 2 gallons per minute (gpm) at 30,000 psi and 1 gpm at 50,000 psi with a different second cam. Thus, the pump system 10 can be configured to provide output pressures from 10,000 psi (often defined as a minimum threshold for high pressure) to 150,000 psi with an output flow rate from 0.25 gpm to 20 gpm.

Thus, by merely designing the cam profile 56, a given pump system can be configured to provide a variety of output flow rates and pressures.

The constant output high-pressure pump system 10 is able to achieve an acceptable pressure variation of less than 10% of a given value for the desired flow rate by controlling the electrical current draw of the drive mechanism 20. The need to achieve a constant flow rate is required by certain high pressure applications. In order to achieve a constant flow rate to meet these needs it is necessary to adjust the electrical current to maintain the proper motor 22 speed.

The cause for the difficulty in compensating for the pressure variation is due to the pressure drop within the system when the inlet check valves are opened. Lower pressure liquid is introduced into the system when these valves open. This liquid must then be converted into a desired higher pressure for the application but while maintaining a constant flow rate at the same time. The drastic pressure drop that occurs when the inlet valves open must be overcome by increasing the electrical current and motor 22 torque in order to equalize the pressure rapidly in the system to maintain a constant output flow rate.

For example, an inlet pressure of the liquid may be 60 psi while the desired constant output pressure may be 60,000 psi so there is a significant difference in low pressure input to high output pressure that needs to be compensated for. This significant change in pressure while trying to maintain a constant flow rate is drastically different than other pumps in the prior art that do not require a variation in electrical current to achieve a constant output flow rate.

The constant output high-pressure pump system 10 can thus be used for waterjet cutting, cleaning, surface preparation and sterilization.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. A high pressure pump system, comprising:

a) a shaft mounted to a electrically driven rotary device;

b) said shaft comprising a cam;

c) means for rotation of said shaft and said cam, with said rotating device;

d) at least two pressurizing subassemblies selectively connected with said cam, each pressurizing subassembly including:

i) a strokable piston rod, whereas the stroke is determined by said cam rotation;

ii) a cam follower support connected to said piston rod;

iii) a high pressure cylinder assembly to receive the stroke of said piston rod, with said high pressure cylinder assembly including at least one sealed interface between said piston rod and said high pressure cylinder assembly;

iv) an upstream low pressure check valve assembly, and a downstream high pressure check valve assembly;

e) at least a first and second said pressurizing subassembly with means to be connected to a common outlet for the transportation of high pressure liquid to at least one system head device via high pressure piping, f) a drive mechanism controlling said rotary device with means for compensation of the system pressure fluctuations of said high pressure liquid to achieve a constant flow rate via said drive mechanism's variable control of electrical current draw each rotation cycle of said shaft, wherein the total said volume of the high pressure pump system is from said inlet check valves to said system head(s);

wherein the high pressure liquid volume is compressed within the said system, and the relationship of liquid compression between the inlet check valves to the system head(s) is directly related to compensation of the flow rate pressure fluctuation via the variation of the electric current draw in the drive mechanism.

2. A high pressure pump system according to claim 1 with compensation of a volume, of said high pressure liquid to achieve a constant flow rate, wherein the total volume of the high pressure pump system is from the said inlet check valves to the said system head(s), with a discharge valve to produce a constant flow rate by reducing pressure fluctuations via draining excess flow to maintain a constant output pressure.

3. The high-pressure pump system of claim 1, with a base plate.

4. The high-pressure pump system of claim 3, wherein a tie brace is fixed relative to the base plate, or wherein a tie brace is releasably fastened to the base plate.

5. The high-pressure pump system of claim 4, wherein the tie brace is rotatably connected to the cam shaft.

6. The high-pressure pump system of claim 4, wherein a tie brace is connected to each high-pressure cylinder assembly.

7. The high-pressure pump system of claim 3, wherein the base plate includes at least one sub plate.

8. The high-pressure pump system of claim 3, wherein the base plate is an integral structure.

9. The high-pressure pump system of claim 3, wherein the base plate is a one piece construction.

10. The high pressure pump system of claim 1, wherein the high-pressure cylinder assembly includes a high-pressure cylinder, the sealed interface between the high-pressure cylinder assembly and the piston rod being formed between the high-pressure cylinder and the piston rod.

11. The high-pressure pump system of claim 1, further comprising a second cam affixed to the cam shaft.

12. The high pressure pump system of claim 1, further comprising a return bias mechanism connected to at least one pressurizing subassembly to maintain contact between the cam and the cam follower throughout rotation of the cam.

13. The high-pressure pump system of claim 1, wherein the cam follower support is a yoke.

14. The high-pressure pump system of claim 1, wherein the first pressurizing subassembly and the second pressurizing subassembly are equally spaced about the cam shaft.

15. The high-pressure pump system of claim 1, wherein the first pressurizing subassembly and the second pressurizing subassembly are spaced unequally about the cam shaft.

16. The high-pressure pump system of claim 1, further comprising a first valving body in the first pressurizing subassembly and a second valving body in the second pressurizing subassembly.

17. The high-pressure pump system of claim 3, with the first cam follower support connected to a base plate by a first linear guide bearing and the second cam follower support connected to the base plate be a second linear guide bearing.

18. The high-pressure pump system of claim 17, with the third cam follower support connected to a base plate by a third linear guide bearing, and each successive cam follower support connected to the base plate by successive linear guide bearings.

19. The high-pressure pump system of claim 17, with a first high-pressure cylinder subassembly connected to a first guide block, and with a second high pressure cylinder subassembly connected to a second guide block.

20. The high-pressure pump system of claim 18, with a third high pressure cylinder subassembly connected to a third guide block, and with each successive high pressure cylinder subassembly connected to successive guide blocks.

21. The high-pressure pump system of claim 19, with a first piston rod connected to the first cam follower support to provide a reciprocating motion of the first piston rod through the first guide block and within the first high pressure cylinder, a second piston rod to the second cam follower support to provide a reciprocating motion of the second piston rod through the second guide block and within the second high pressure cylinder.

22. The high-pressure pump system of claim 20, with a third piston rod connected to the third cam follower support to provide a reciprocating motion of the third piston rod through the third guide block and within the third high pressure cylinder; with each successive piston rod connected to each successive cam follower support to provide a reciprocating motion of each successive piston rod through each successive guide block and within each successive high pressure cylinder.

23. The high-pressure pump system of claim 1, wherein an attenuator device, or accumulation method is added to the high pressure piping in order to achieve a constant flow rate.

24. The high-pressure pump system of claim 2, wherein an attenuator device, or accumulation method is added to the high pressure piping in order to achieve a constant flow rate.

25. The high pressure pump system of claim 1, wherein the said liquid is continuously discharged at the system head device upon demand into waterjet cutting, cleaning, surface preparation and sterilization applications.

26. A high pressure pump system according to claim 1 with compensation of the volume of said high pressure liquid to achieve a constant flow via selection of a constant cam/shaft rotating speed in conjunction with a specific cam profile to overcome the pressure fluctuation created by transforming low pressure inlet liquid into high pressure liquid within the said system to deliver a constant output pressure.

27. A high pressure open discharge pump system according to claim 1 with compensation of the volume of said high pressure liquid to achieve a constant flow via selection of a variable speed rotation of the said cam/shaft to overcome the pressure fluctuation created by transforming low pressure inlet liquid into high pressure liquid within the said system to deliver a constant output pressure.

28. A high pressure open discharge pump system according to claim 1 with compensation of the volume of said high pressure liquid to achieve a constant flow via selection of a variable speed cam rotation in conjunction with the said cam profile to overcome the pressure fluctuation created by transforming low pressure inlet liquid into high pressure liquid within the said system to deliver a constant output pressure.

29. A high pressure open discharge pump system according to claim 1 where the constant flow rate is within 10% variation of a given output pressure value.

* * * * *